US010065820B2

(12) United States Patent
Yokoyama

(10) Patent No.: US 10,065,820 B2
(45) Date of Patent: Sep. 4, 2018

(54) SHEET CONVEYING APPARATUS

(71) Applicant: CANON FINETECH NISCA INC., Misato-shi (JP)

(72) Inventor: Naoki Yokoyama, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/378,077

(22) Filed: Dec. 14, 2016

(65) Prior Publication Data

US 2017/0183175 A1 Jun. 29, 2017

(30) Foreign Application Priority Data

Dec. 28, 2015 (JP) ..... 2015-256162

(51) Int. Cl.
*B65H 3/06* (2006.01)
*B65H 5/06* (2006.01)
*G03G 15/00* (2006.01)

(52) U.S. Cl.
CPC ..... *B65H 5/062* (2013.01); *B65H 3/0676* (2013.01); *G03G 15/651I* (2013.01); *G03G 15/6529* (2013.01); *B65H 2403/72* (2013.01); *G03G 2215/00396* (2013.01)

(58) Field of Classification Search
CPC ..... B65H 3/06; B65H 3/0623; B65H 3/0684; B65H 3/52; B65H 3/5215; B65H 3/5253; B65H 3/5261; B65H 3/062; B65H 3/0671; B65H 2403/72; G03G 15/6529
USPC ..... 271/122, 124, 125
See application file for complete search history.

(56) References Cited

U.S. PATENT DOCUMENTS 3,825,248 A * 7/1974 Friend ..... B07C 1/04 271/10.13
4,627,607 A * 12/1986 Ishii ..... B65H 3/5261 271/122
4,852,868 A * 8/1989 Fukui ..... B65H 1/12 271/122
5,172,899 A * 12/1992 Tajima ..... B65H 3/5261 271/122

(Continued)

FOREIGN PATENT DOCUMENTS

JP 10-181914 A 7/1998
JP 2000-085998 A 3/2000

(Continued)

OTHER PUBLICATIONS

Office Action dated Dec. 25, 2017, in Japanese Patent Application No. 2015-256162.

*Primary Examiner* — David H Bollinger
(74) *Attorney, Agent, or Firm* — Fitzpatrick, Cella, Harper & Scinto

(57) ABSTRACT

A sheet conveying apparatus configured to convey a sheet includes: a rotatable support portion configured to support a rotary portion which is configured to convey a sheet; an urging portion configured to urge the support portion in a direction of a rotary shaft center of the support portion with a support shaft, which is configured to support the support portion in a rotatable manner and is inserted through the urging portion; and a regulating portion configured to regulate a position of the support portion urged by the urging portion.

14 Claims, 7 Drawing Sheets

(56) References Cited

U.S. PATENT DOCUMENTS

| | | | | | |
|---|---|---|---|---|---|
| 5,172,900 | A * | 12/1992 | Uno | B65H 3/5261 | 271/125 |
| 5,333,848 | A * | 8/1994 | Rubscha | B65H 3/5261 | 271/117 |
| 5,351,945 | A * | 10/1994 | Asakawa | B65H 3/5261 | 271/118 |
| 5,996,990 | A | 12/1999 | Kawashima | | |
| 7,497,430 | B2 * | 3/2009 | Kusumi | B65H 3/0669 | 271/10.03 |
| 2005/0179192 | A1 * | 8/2005 | Miura | B65H 3/06 | 271/118 |

FOREIGN PATENT DOCUMENTS

| | | | |
|---|---|---|---|
| JP | 2000-198563 | A | 7/2000 |
| JP | 2004-115165 | A | 4/2004 |
| JP | 2006-347711 | A | 12/2006 |
| JP | 2009-001390 | A | 1/2009 |
| JP | 2009-120293 | A | 6/2009 |
| JP | 2014-185000 | A | 10/2014 |

* cited by examiner

SHEET CONVEYING APPARATUS

BACKGROUND OF THE INVENTION

Field of the Invention

The present invention relates to a sheet conveying apparatus configured to convey a sheet, and more particularly, to a conveying mechanism configured to convey the sheet.

DESCRIPTION OF THE RELATED ART

Hitherto, there has been known a sheet conveying apparatus configured to convey a sheet through use of a rotary member, e.g., a roller. For example, in an image forming system such as a copying machine or a printer, there is a sheet conveying apparatus configured to separate sheets stacked on a stacking portion, e.g., a receiving tray, into individual sheets to feed the sheets to an image forming portion configured to perform image forming processing on the sheets.

The sheet conveying apparatus includes a placing portion on which the sheets are stacked, a feeding roller configured to come into contact with an upper surface of the sheets stacked on the placing portion to feed the sheets from the placing portion, a separating and feeding mechanism configured to separate the fed sheets into individual sheets and to feed the separated sheets, and a conveyance roller pair configured to convey the sheets separated into the individual sheets to an image forming apparatus. The sheets stacked on the placing portion are conveyed to the image forming apparatus along a feeding path by the feeding roller, the separating and feeding mechanism, and the conveyance roller pair.

Hitherto, there has been known a separating and feeding mechanism including a sheet feeding roller configured to convey the sheets to downstream, a separation roller configured to rotate in a direction reverse to a sheet feeding direction and to separate following sheets from a sheet to be conveyed, a separation roller shaft to which the separation roller is mounted, a drive shaft configured to transmit rotation to the separation roller shaft, an arm member, which is supported in a swingable manner by the drive shaft and supports the separation roller shaft in a rotatable manner, a pressure spring configured to urge the arm member toward the sheet feeding roller to allow the separation roller to come into press contact with the sheet feeding roller. The sheets are separated due to friction between the separation roller and the sheets against a frictional force between the sheets.

In the separating and feeding mechanism, when the sheets are separated from one another, a stick-slip phenomenon may occur. When the stick-slip phenomenon occurs, the sheets and the separation roller vibrate, and hence abnormal sound or noise of the roller may be generated. Along with occurrence of the stick-slip phenomenon, the arm member supporting the separation roller shaft may also vibrate. Therefore, there is a problem in that noise is liable to become louder due to the arm member and the drive shaft.

The separating and feeding mechanism of the sheet conveying apparatus is described above. Other than the separating and feeding mechanism, when a configuration in which the arm member supports the drive shaft is adopted, there is a similar problem in that the arm member is liable to vibrate to generate noise.

SUMMARY OF THE INVENTION

According to one embodiment of the present invention, there is provided a sheet conveying apparatus, which is configured to convey a sheet, including: a rotary portion configured to rotate to convey a sheet; a support portion configured to support the rotary portion in a rotatable manner; a support shaft configured to support the support portion in a rotatable manner; an urging portion configured to urge the support portion in a direction of a rotary shaft center about which the support portion rotates, the support shaft being inserted through the urging portion; and a regulating portion configured to regulate a position of the support portion urged by the urging portion.

With this configuration, vibration of the support portion in the direction of the shaft center can be reduced, thereby suppressing generation of noise.

Further features of the present invention will become apparent from the following description of exemplary embodiments with reference to the attached drawings.

DESCRIPTION OF THE EMBODIMENTS

Figure 1:
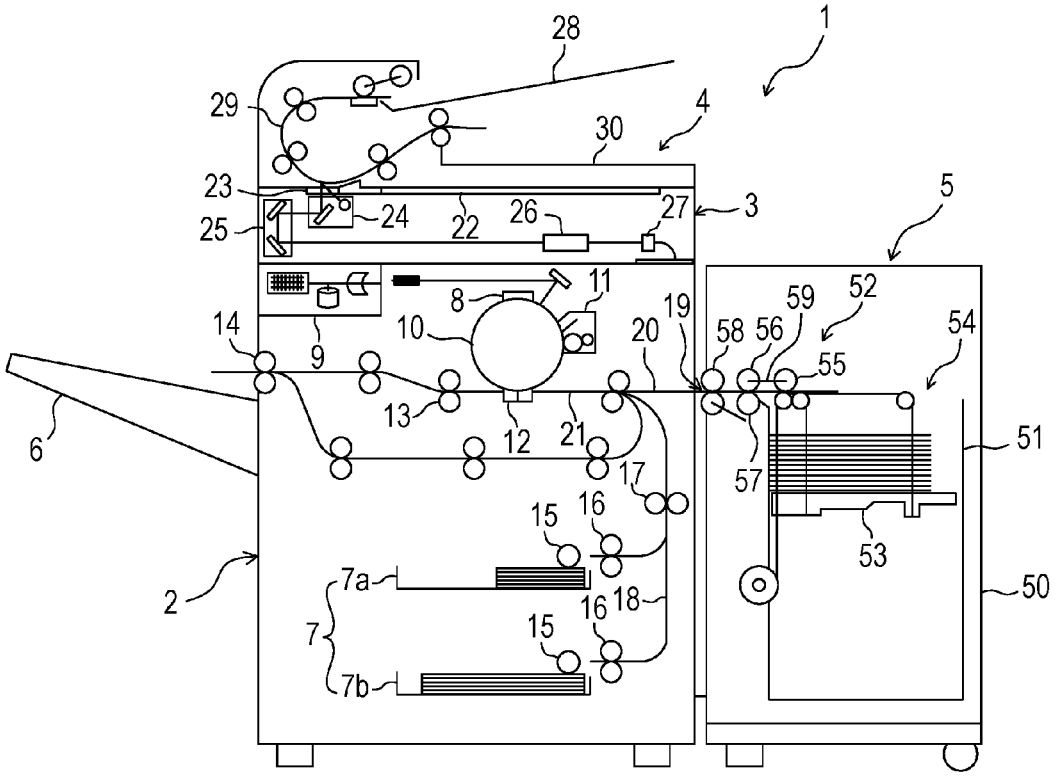
FIG. 1 is an overall configuration view of an image forming system including a sheet feeding apparatus, which is an example of a sheet conveying apparatus.

Now, a sheet feeding apparatus for use in an image forming system is taken as an example of a sheet conveying apparatus to describe an embodiment of the present invention in detail with reference to the attached drawings.

An overall configuration of an image forming system 1 is described with reference to FIG. 1. The image forming system 1 includes an image forming apparatus 2, a document reading apparatus 3, a document feeding apparatus 4, a sheet feeding apparatus 5, and a sheet accumulation apparatus 6. The image forming apparatus 2 includes sheet feeding cassettes 7 each capable of storing about 100 sheets (two sheet feeding cassettes 7*a* and 7*b* are provided in the illustrated embodiment). The image forming apparatus 2 performs an image forming operation, which is based on image data read from an image of a document by the document reading apparatus 3, on a sheet fed from any one of the sheet feeding cassette 7*a*, the sheet feeding cassette 7*b*, and the sheet feeding apparatus 5. Further, the image forming apparatus 2 allows the sheet having the image formed thereon to be accumulated and stored on the sheet accumulation apparatus 6. A document sheet can be fed to the document reading apparatus 3 also by the document feeding apparatus 4. Sheets that may be used in the image forming system 1 include plain sheets, OHP sheets, tracing sheets, and coated sheets.

The image forming apparatus 2 is, for example, a copying machine, a printer, or a facsimile machine, and can be immovably installed on a floor surface. The image forming apparatus 2 need only be capable of forming an image on a sheet, and hence various image forming mechanisms may be employed. In the illustrated embodiment, an electrostatic image forming mechanism is employed as an image forming mechanism. However, the image forming mechanism of the image forming apparatus 2 is not limited to the electrostatic image forming mechanism, and an ink jet image forming mechanism or an offset image forming mechanism may also be employed.

The image forming apparatus 2 illustrated in FIG. 1 includes a charger 8, an exposure device (e.g., a laser head) 9, a photosensitive drum 10, a developing unit 11, a transfer charger 12, and a fixing roller 13. An electrostatic latent image (static image) is formed with the exposure device 9 on a surface of the photosensitive drum 10 charged by the charger 8. The developing unit 11 allows toner to adhere onto the electrostatic latent image. The toner adhering onto the photosensitive drum 10 is transferred by the transfer charger 12 onto a sheet which is fed from the sheet feeding cassettes 7*a* and 7*b* of the sheet feeding portion 7, or from the sheet feeding apparatus 5. The sheet carrying the toner transferred thereon is conveyed to the fixing roller 13 arranged downstream, and the toner carried on the sheet is heated and fixed. After that, the sheet is delivered to the sheet accumulation apparatus 6 by a sheet delivery roller pair 14.

Each of the sheet feeding cassettes 7*a* and 7*b* includes a pickup roller 15 configured to come into contact with an uppermost surface of sheets stored therein to feed the sheets, and a separation roller pair 16 configured to separate the fed sheets into individual sheets and feed the separated sheets. The sheets are fed from each of the sheet feeding cassettes 7*a* and 7*b* by the pickup rollers 15, and separated into individual sheets by the separation roller pairs 16. The sheets are conveyed through a cassette conveyance path 18 by a conveyance roller pair 17, and join a feeding path 20 communicating with a feeding outlet 19 of the sheet feeding apparatus 5. Then, the sheets are conveyed to the transfer charger 12 along a conveyance path 21.

On top of the document reading apparatus 3, there are provided a first platen 22 and a second platen 23, which are made of transparent glass, juxtaposed in a horizontal direction. The first platen 22 is used for reading a document set thereon by hand, and is formed to have such a size as to enable placement of a document having an applicable maximum size. The second platen 23 is used for reading a document which is fed from the document feeding apparatus 4 and moved at a predetermined speed.

In the document reading apparatus 3, there are provided a first reading carriage 24, a second reading carriage 25, a condenser lens 26, and a photoelectric conversion unit including a photoelectric conversion element 27. The first reading carriage 24 and the second reading carriage 25 are driven by a carriage motor (not shown) to reciprocate in a sub-scanning direction under the first platen 22. In the first reading carriage 24, there are provided a lamp configured to irradiate light to a document, and a mirror configured to reflect light reflected from the document. In the second reading carriage 25, there are provided two mirrors configured to guide the light from the mirror of the first reading carriage 24 to the condenser lens 26 and the photoelectric conversion element 27. When a document placed on the first platen 22 is to be read, light is irradiated from the first reading carriage 24 to an image of the document placed on the first platen 22 while the first reading carriage 24 and the second reading carriage 25 are moved. Then, light reflected from the document is guided to the photoelectric conversion element 27 through the first reading carriage 24 and the second reading carriage 25 and converted into an electric signal. Accordingly, image data is generated from the document. The generated image data is transmitted as an image signal to the exposure device 9 of the image forming apparatus 2.

The document feeding apparatus 4 includes a feeding tray 28, a sheet conveying mechanism 29, and a delivery tray 30. Documents placed on the feeding tray 28 are conveyed one after another by the sheet conveying mechanism 29, passed above the second platen 23, and delivered to the delivery tray 30. When a document that is fed from the document feeding apparatus 4 and passed above the second platen 23 is to be read, the first reading carriage 24 and the second reading carriage 25 are stopped in advance under the second platen 23. With this, image data is generated from the document passed above the second platen 23.

The sheet feeding apparatus 5 being an example of a sheet conveying apparatus includes a housing (feeding apparatus body) 50, a storage unit 51 which is drawably supported by a drawing mechanism (not shown) in the housing 50 and serves as a stacking unit configured to stack sheets, and a separating and feeding mechanism 52 configured to separate the sheets stored in the storage unit 51 into individual sheets and to feed the sheets to the image forming apparatus 2. In the storage unit 51, there is provided a stacking tray 53 serving as a lifting unit which is capable of going up and down in upward and downward directions. The stacking tray 53 is a flat plate, and sheets can be stacked on the stacking tray 53. At an upper part of the storage unit 51, there is provided a sheet upper surface detection sensor (not shown) configured to detect a position of an uppermost surface of sheets stacked on the stacking tray 53. The stacking tray 53 is moved by a lifting mechanism 54 in accordance with an amount of sheets.

Figure 2:
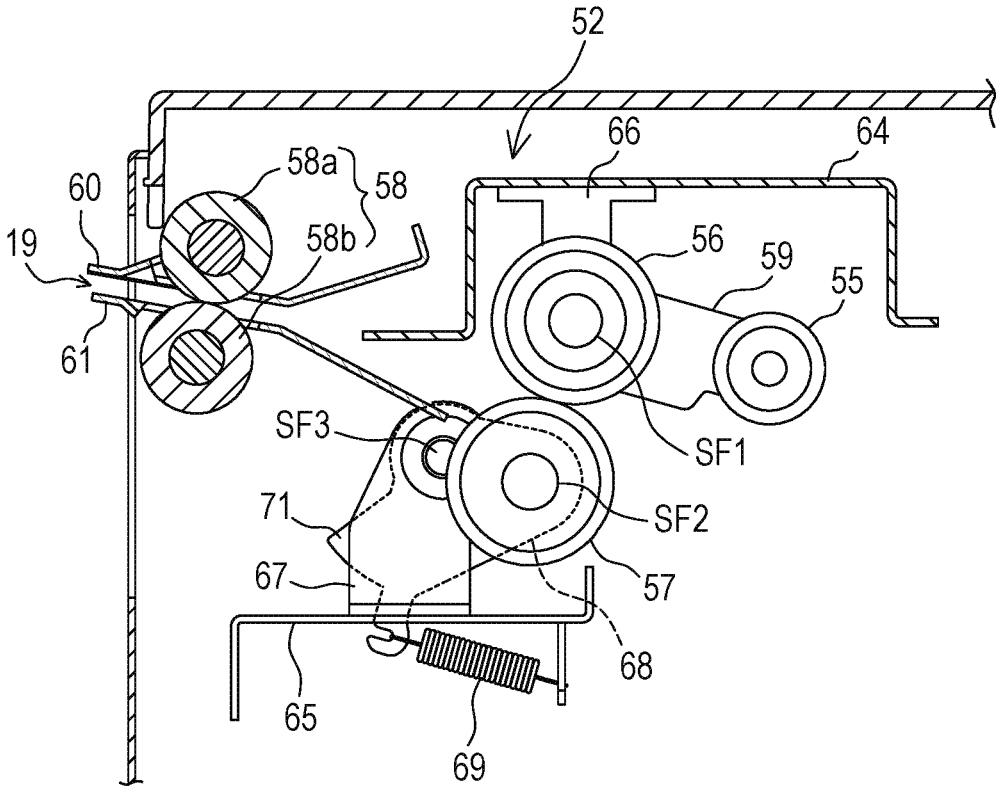
FIG. 2 is an enlarged sectional view of a separating and feeding mechanism of the sheet feeding apparatus.

With reference to FIG. 2, the separating and feeding mechanism 52 of the sheet feeding apparatus 5 is described. As illustrated in FIG. 2 in detail, the separating and feeding mechanism 52 includes a pickup roller 55 configured to come into contact with an uppermost surface of the sheets stacked on the stacking tray 53 to feed the sheets, a separation unit configured to separate the fed sheets into the individual sheets and to feed the separated sheets, and a conveyance roller pair 58 configured to convey the sheets separated into the individual sheets by the separation unit to the image forming apparatus 2.

The conveyance roller pair 58 includes a driving roller 58*a* configured to be driven by a conveyance motor (not shown), and a driven roller 58*b* configured to follow the driving roller 58*a* to rotate. The conveyance motor (not shown) causes the driving roller 58*a* to rotate, and hence the sheets are delivered from the feeding outlet 19 of the sheet feeding apparatus 5 and fed to the image forming apparatus 2.

The separation unit includes a sheet feeding roller 56 (conveyance rotary member) as a first roller, a separation roller 57 (separation rotary member) as a second roller, which comes into press contact with the sheet feeding roller 56 to prevent feeding of a second sheet and subsequent sheets, a sheet feeding roller shaft SF1 as a first roller shaft to which the sheet feeding roller 56 is mounted, and a separation roller shaft SF2 (rotary shaft) as a second roller shaft to which the separation roller 57 is mounted.

As illustrated in FIG. 2, the pickup roller 55 is supported in a rotatable manner by a bracket 59, which is supported in a swingable manner about a shaft center of the sheet feeding roller shaft SF1. The pickup roller 55 presses the uppermost surface of the sheets stacked on the stacking tray 53 with its own weight. The sheet feeding roller 56 is driven by a sheet feeding motor M1 through intermediation of the drive transmitting mechanism, and rotates through drive of the sheet feeding motor M1 to feed the sheets. Further, the pickup roller 55 is driven to rotate when rotation of the sheet feeding motor M1 is transmitted to the pickup roller 55 through intermediation of the sheet feeding roller shaft SF1.

A torque limiter 62 (see FIG. 3) is mounted between the separation roller shaft SF2 and the separation roller 57. With this, when two or more overlapping sheets are nipped at a press contact portion between the sheet feeding roller 56 and the separation roller 57, the separation roller 57 is stopped to prevent feeding of the second sheet and subsequent sheets. That is, when a plurality of overlapping sheets enter a nip portion between the sheet feeding roller 56 and the separation roller 57, a rotary force of the feeding roller 56 is transmitted to the uppermost first sheet. Meanwhile, the separation roller 57 rotates in a direction reverse to a direction of conveying the uppermost first sheet (sheet feeding direction) due to operation of the torque limiter 62. Then, slippage between the uppermost first sheet and the second sheet and subsequent sheets is caused so that the uppermost first sheet is separated from the second sheet and subsequent sheets. When there is one sheet between the sheet feeding roller 56 and the separation roller 57, a rotary force of the sheet feeding roller 56 is transmitted to the separation roller 57 through intermediation of the sheet. Further, the separation roller 57 rotates in the sheet feeding direction due to operation of the torque limiter 62.

The separating and feeding mechanism 52 further includes an upper guide 60 and a lower guide 61 provided so as to be opposed to each other to form a feeding path configured to guide sheets.

Figure 3:
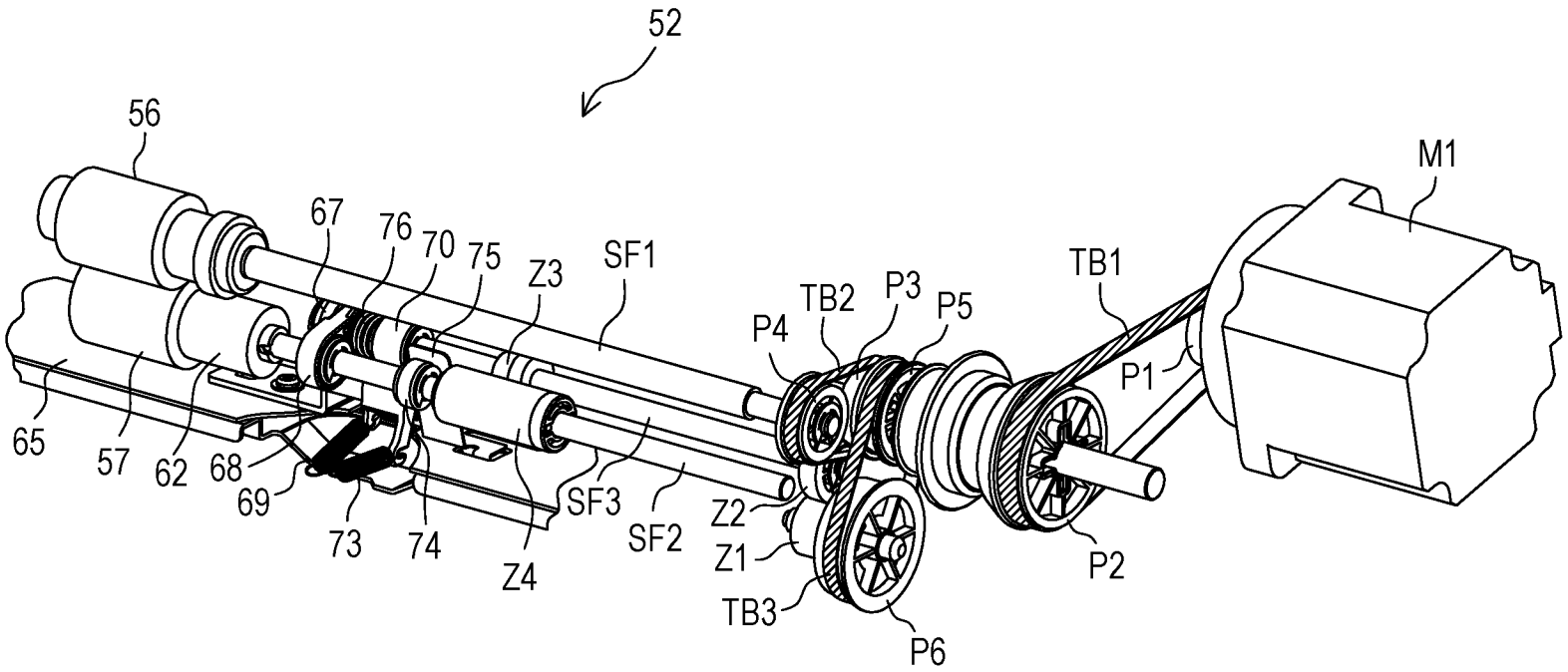
FIG. 3 is a perspective view for illustrating a drive transmitting mechanism of a sheet feeding roller and a separation roller of the separating and feeding mechanism of the sheet feeding apparatus.
Figure 4:
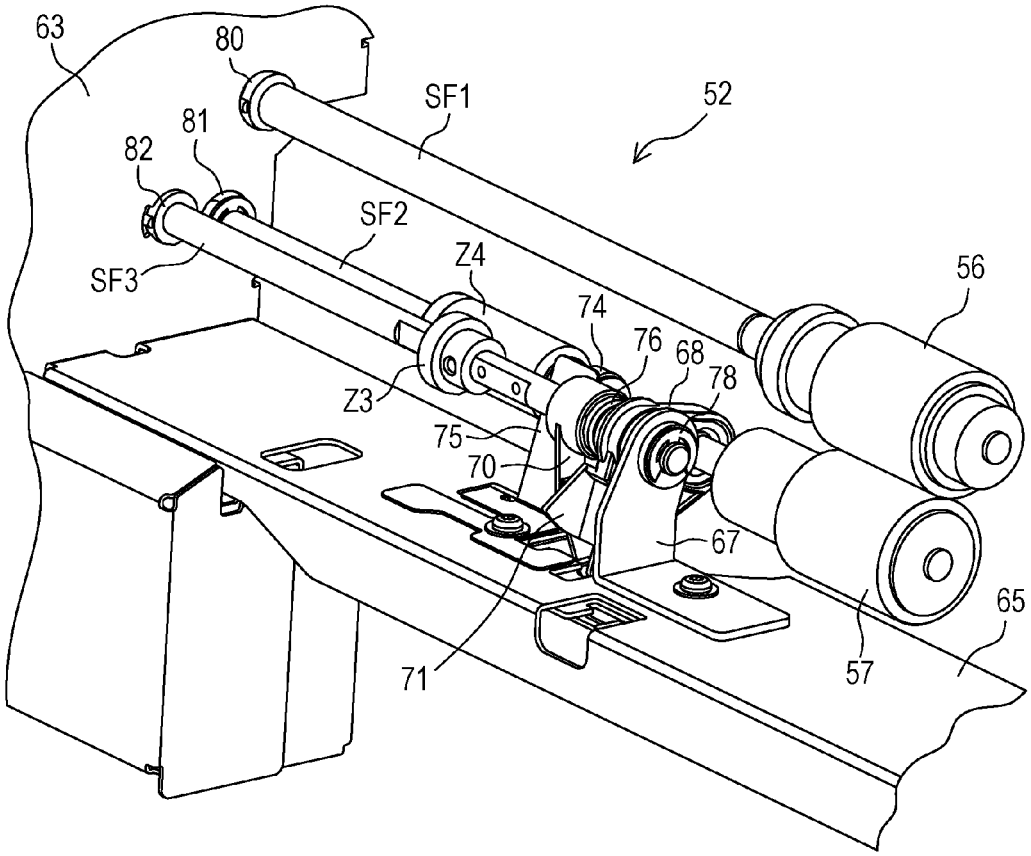
FIG. 4 is a perspective view for illustrating a support portion of a sheet feeding roller shaft, a separation roller shaft, and an intermediate shaft of the sheet feeding apparatus.
Figure 5:
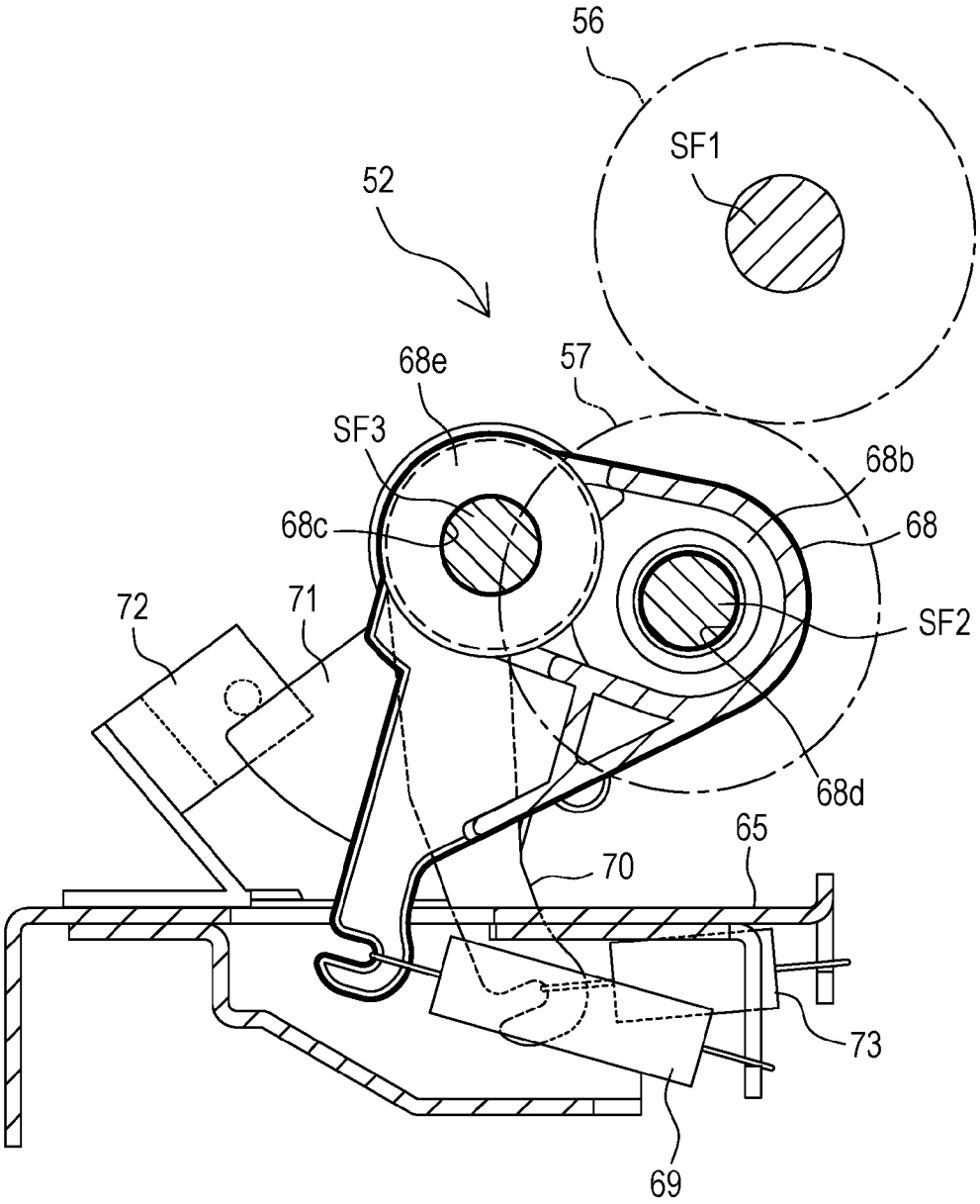
FIG. 5 is an enlarged sectional view for illustrating main parts of a mechanism configured to cause the separation roller to come into press contact with and to be separated from the sheet feeding roller of the sheet feeding apparatus.

With reference to FIG. 3 to FIG. 5, the drive transmitting mechanism configured to transmit a driving force to the sheet feeding roller 56 and the separation roller 57 is described. FIG. 3 is a perspective view for illustrating the drive transmitting mechanism configured to transmit a driving force to the sheet feeding roller 56 and the separation roller 57. FIG. 4 is a perspective view for illustrating the support portion of the sheet feeding roller shaft SF1, the separation roller shaft SF2, and an intermediate shaft SF3. FIG. 5 is an enlarged sectional view for illustrating main parts of a configuration for causing the separation roller 57 to come into press contact with and to be separated from the sheet feeding roller 56. In FIG. 3, for easy understanding of the configuration, side plates 63 are omitted.

The drive transmitting mechanism includes the sheet feeding motor M1, a first pulley P1 mounted to a driving shaft of the sheet feeding motor M1, a second pulley P2 forming a pair with the first pulley P1, a third pulley P3 mounted on a rotary shaft to which the second pulley P2 is mounted, a fourth pulley P4 mounted to the sheet feeding roller shaft SF1, a fifth pulley P5 mounted, as similar to the third pulley P3, on the rotary shaft to which the second pulley P2 is mounted, a sixth pulley P6 forming a pair with the fifth pulley, a first timing belt TB1 looped around the first pulley P1 and the second pulley P2, a second timing belt TB2 looped around the third pulley P3 and the fourth pulley P4, a third timing belt TB3 looped around the fifth pulley P5 and the sixth pulley P6, a first gear Z1 provided on a rotary shaft to which the sixth pulley P6 is mounted, the intermediate shaft SF3 serving as a support shaft, which is arranged so as to extend substantially in parallel to the separation roller shaft SF2 in a direction of feeding the sheet, a second gear Z2, which is provided on the intermediate shaft SF3 and held in mesh with the first gear Z1, a third gear Z3 provided on the intermediate shaft SF3, and a fourth gear Z4, which is provided on the separation roller shaft SF2 and held in mesh with the third gear Z3.

With this configuration, when the sheet feeding motor M1 rotates in a forward direction, a rotary driving force of the sheet feeding motor M1 is transmitted to the sheet feeding roller shaft SF1 through intermediation of the first pulley P1, the first timing belt TB1, the second pulley P2, the third pulley P3, the second timing belt TB2, and the fourth pulley P4. Further, the sheet feeding roller 56 rotates in the sheet feeding direction (counterclockwise direction in FIG. 3). The rotary driving force of the sheet feeding motor M1 is transmitted to the intermediate shaft SF3 through intermediation of the first pulley P1, the first timing belt TB1, the second pulley P2, the fifth pulley P5, the third timing belt TB3, the sixth pulley P6, the first gear Z1, and the second gear Z2. Further, the rotary driving force of the sheet feeding motor M1 is transmitted from the intermediate shaft SF3 to the separation roller shaft SF2 through intermediation of the third gear Z3 and the fourth gear Z4. With this, the separation roller shaft SF2 is applied with a rotary force for rotating the separation roller 57 in a direction reverse to the sheet feeding direction (counterclockwise direction in FIG. 3). The separation roller shaft SF2 and the separation roller 57 construct a rotary portion configured to convey the sheets through rotation.

As a part of a frame of a housing of the sheet feeding apparatus 5, a pair of side plates 63 and 63 are arranged so as to sandwich the sheet feeding roller 56 and the separation roller 57 therebetween. The sheet feeding roller shaft SF1 is supported in a cantilever manner by a support member 66 and a bearing 80 so that one end of the sheet feeding roller shaft SF1 is a free end. The support member 66 is mounted to an upper plate 64, which is arranged so as to bridge between the pair of side plates 63 (see FIG. 2). The bearing 80 is mounted to one of the side plates 63. The sheet feeding roller 56 is mounted to the free end of the sheet feeding roller shaft SF1. The intermediate shaft SF3 is supported by a support plate 67 and a bearing 82. The support plate 67 is mounted to a lower plate 65, which is arranged so as to bridge between the pair of side plates 63. The bearing 82 is mounted to the one of the side plates 63, to which the sheet feeding roller shaft SF1 is mounted. The separation roller shaft SF2 is supported in a cantilever manner by a bearing 81 (bearing member) and an arm member 68 so that one end of the separation roller shaft SF2 is a free end. The bearing is mounted to the side plate 63 supporting the sheet feeding roller shaft SF1. The arm member 68 serving as a support member is mounted to the intermediate shaft SF3 and constructed in a swingable manner about a shaft center of the intermediate shaft SF3. The separation roller 57 is mounted to the free end of the separation roller shaft SF2. The intermediate shaft SF3 has the shaft center which is different from the rotary shaft center of the separation roller 57. The arm member 68 is supported in a rotatable manner about the shaft center by the intermediate shaft SF3.

The arm member 68 supporting the separation roller shaft SF2 is supported in a swingable manner by the intermediate shaft SF3 serving as a support shaft while the intermediate shaft SF3 passes through a through hole 68*c* (first through hole) formed in one end 68*e* (base end). The separation roller shaft SF2 is supported in a rotatable manner by the arm member 68 while the separation roller shaft SF2 passes through a through hole 68*d* (second through hole) formed in another end 68*b* (distal end). Further, as illustrated in FIG. 5, the arm member 68 is urged by a tensile spring 69 serving as a press contact member to rotate about the shaft center of the intermediate shaft SF3 in the counterclockwise direction. The tensile spring 69 causes the separation roller shaft SF2 supported by the arm member 68 to rotate in a direction of approaching to the sheet feeding roller 56 so that the separation roller 57 comes into press contact with the sheet feeding roller 56. In this state, the separation roller shaft SF2 is inclined with the support portion (bearing portion) of the side plate 63 as a fulcrum.

Figure 6:
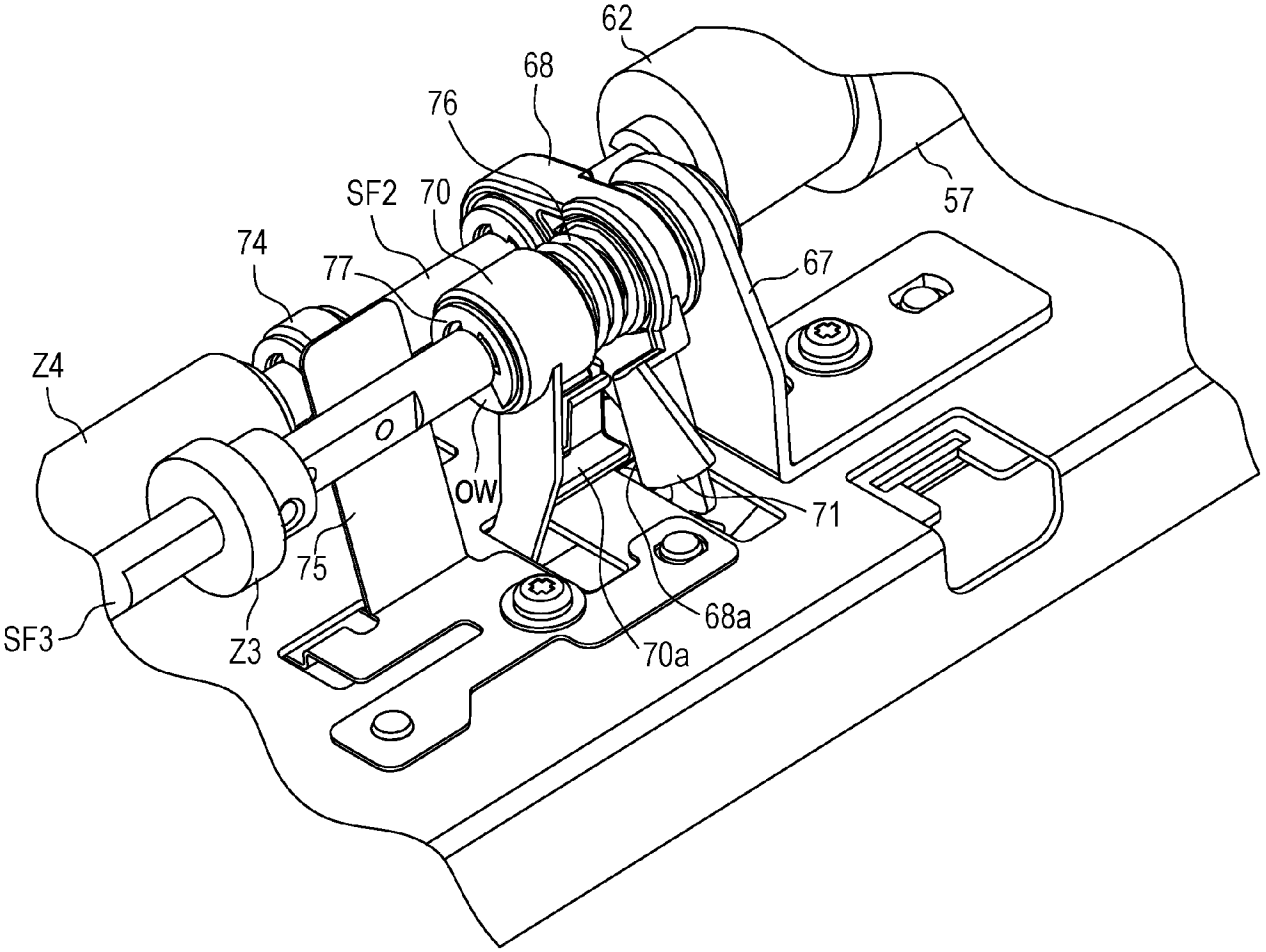
FIG. 6 is an enlarged perspective view for illustrating main parts of a mechanism configured to suppress a stick-slip phenomenon and noise generated by the stick-slip phenomenon in the sheet feeding apparatus.
Figure 7:
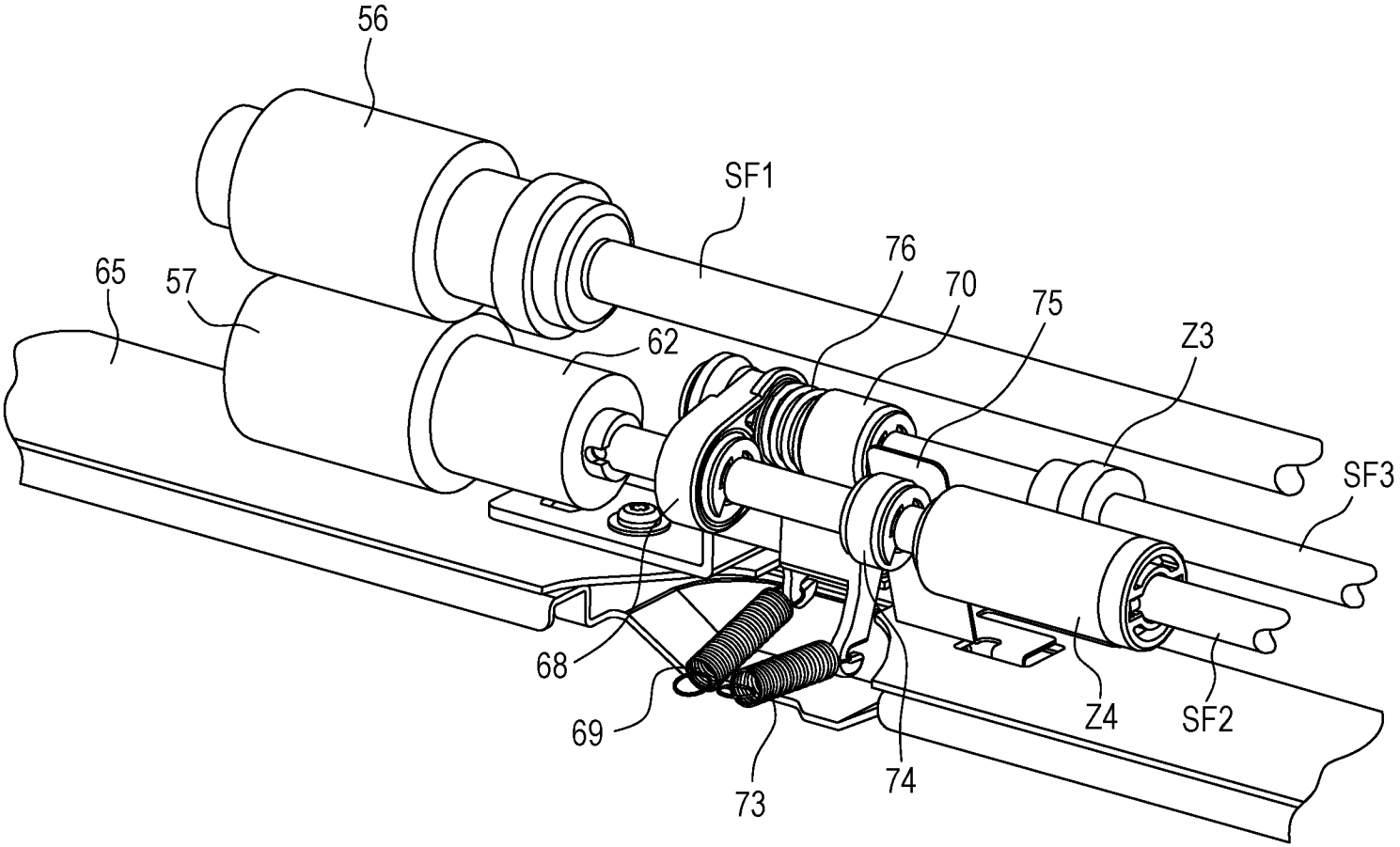
FIG. 7 is a perspective view for illustrating the main parts of the mechanism configured to suppress the stick-slip phenomenon and noise generated by the stick-slip phenomenon in the sheet feeding apparatus as viewed from an angle different from that in FIG. 6.

As illustrated in FIG. 6 in detail, in the separating and feeding mechanism 52, there are arranged a separation lever 70, which is mounted to the intermediate shaft SF3 and has an abutment piece 70*a*, an abutment portion 68*a* formed in the arm member 68 so as to be opposed to the abutment piece 70*a*, and a detection flag 71 protruding and extending from the arm member 68 in a radial direction. The arm member 68 and the separation lever 70 are brought into abutment against each other so that the separation roller 57 is separated from the sheet feeding roller 56. As a result, a position of the separation roller 57 is detected, to thereby detect contact and separation between the sheet feeding roller 56 and the separation roller 57. In the illustrated embodiment, the detection flag 71 is arranged at a position opposed to the abutment piece 70*a*. In the vicinity of the detection flag 71 opposed to the abutment piece 70*a*, the abutment portion 68*a* is formed.

When the separation roller 57 is separated from the sheet feeding roller 56, the sheet feeding motor M1 first rotates in a direction reverse to the sheet feeding direction to rotate the intermediate shaft SF3. Then, the separation lever 70 mounted to the intermediate shaft SF3 rotates in a counterclockwise direction in FIG. 6. With this, the abutment piece 70*a* of the separation lever 70 is brought into abutment against the abutment portion 68*a* of the arm member 68, and allows the arm member 68 to rotate about the shaft center of the intermediate shaft SF3 in the counterclockwise direction in FIG. 6 against an urging force of the tensile spring 69. When the arm member 68 rotates in the counterclockwise direction, the separation roller shaft SF2 moves in a direction away from the sheet feeding roller 56. Then, the separation roller 57 is separated from the sheet feeding roller 56. In this state, the separation roller shaft SF2 is inclined with the support portion (bearing portion) of the side plate 63 as a fulcrum so that the separation roller 57 is separated from the sheet feeding roller 56.

The detection flag 71 configured to detect a position of the separation roller 57 crosses an optical path of a photo sensor 72 (see FIG. 5) having a light emitting element and a light receiving element. When the separation roller 57 is at a press contact position at which the separation roller 57 comes into press contact with the sheet feeding roller 56, the detection flag 71 releases the optical path of the photo sensor 72. When the separation roller 57 is at a separation position at which the separation roller 57 is separated from the sheet feeding roller 56, the separation roller 57 blocks the optical path of the photo sensor 72. That is, the photo sensor 72 is arranged so as to be in an off-state when the separation roller 57 is at the press contact position, and to be in an on-state when the separation roller 57 is at the separation position. A rotational direction of the sheet feeding roller 56 is regulated based on a detection result of the photo sensor 72.

A one-way clutch OW is arranged between the separation lever 70 and the intermediate shaft SF3. Due to the one-way clutch OW, a rotation of the intermediate shaft SF3 in a clockwise direction in FIG. 6 is not transmitted to the separation lever 70. As illustrated in FIG. 5, the separation lever 70 is urged to rotate in a counterclockwise direction in FIG. 5 (clockwise direction in FIG. 6) by a tensile spring 73 serving as an urging unit. Under a state in which a rotary drive of the intermediate shaft SF3 is not transmitted, the separation lever 70 is held at a position at which the abutment piece 70*a* is away from the abutment portion 68*a* of the arm member 68. That is, when the intermediate shaft SF3 rotates in the counterclockwise direction in FIG. 6, the separation lever rotates in the counterclockwise direction in FIG. 6 against an urging force of the tensile spring 73.

In order to prevent abnormal sound and noise generated by stick slip of a sheet, the separating and feeding mechanism 52 of the sheet feeding apparatus 5 further includes a first braking (regulating) unit and a second braking (regulating) unit. The first braking unit urges the separation roller shaft SF2 in a direction intersecting the shaft center of the separation roller shaft SF2 (radial direction), to thereby regulate vibration of the separation roller shaft SF2. The second braking unit urges the arm member 68 in a direction in which the shaft center of the intermediate shaft SF3 extends (thrust direction), to thereby regulate vibration of the arm member 68.

In this embodiment, the first braking unit includes a bearing 74 (bearing member) including an outer ring and an inner ring, which are mounted to the separation roller shaft SF2, a plate spring 75 (elastic member) mounted to the lower plate 65. The plate spring 75 is arranged so as to be brought into abutment against the outer ring of the bearing 74 to urge the separation roller shaft SF2 toward downstream of the direction of feeding sheet in a direction intersecting a direction in which the separation roller 57 is brought into press contact with the sheet feeding roller 56 (hereinafter referred to as "press contact direction"). The plate spring 75 is able to urge the separation roller shaft SF2 in a direction of an imaginary line connecting a center of the separation roller shaft SF2 and a center of the intermediate shaft SF3. The plate spring 75 may urge the separation roller shaft SF2 in a direction perpendicular to the press contact direction.

When the plate spring 75 urges the separation roller shaft SF2 in a direction intersecting the press contact direction, the separation roller shaft SF2 is pressed against an inner peripheral surface of a bearing hole of the side plate 63 supporting the separation roller shaft SF2 and an inner peripheral surface of the through hole of the arm member 68. Then, the separation roller shaft SF2 is braked. As a result, vibration of the separation roller shaft SF2 with respect to the arm member 68 is suppressed. Further, wobble between the separation roller shaft SF2 and the bearing hole of the side plate 63 and wobble between the separation roller shaft SF2 and the through hole of the arm member 68 are prevented, and hence noise can be reduced.

The plate spring 75 urges the separation roller shaft SF2 through intermediation of the bearing 74 arranged so that the outer ring thereof is rotatable with respect to the separation roller shaft SF2. With this, even when the separation roller shaft SF2 is urged by the plate spring 75, increase in rotary load can be suppressed when rotating the separation roller shaft SF2. The plate spring 75 is arranged so as to urge the separation roller shaft SF2 toward downstream of the direction of feeding sheet in a direction intersecting the press contact direction. Thus, an effect of urging of the plate spring 75 on a pressing force (press contact force) of the separation roller 57 with respect to the sheet feeding roller 56 can be suppressed. Particularly, the plate spring 75 is arranged so as to urge the separation roller shaft SF2 toward downstream of the direction of feeding sheet in a direction perpendicular to the press contact direction. With this, the effect of urging of the plate spring 75 on a pressing force of the separation roller 57 with respect to the sheet feeding roller 56 can be minimized.

The separation roller shaft SF2 and the intermediate shaft SF3 are arrayed in the direction of feeding the sheet. The plate spring 75 urges the separation roller shaft SF2 in a direction opposite to the direction of feeding the sheet, that is, in an array direction of the separation roller shaft SF2 and the intermediate shaft SF3. The separation roller shaft SF2 is supported by the intermediate shaft SF3 through intermediation of the arm member 68. Therefore, as the separation roller shaft SF2 is urged by the plate spring 75, the arm member 68 and the intermediate shaft SF3 are also urged in the direction opposite to the direction of feeding the sheet. With this, the intermediate shaft SF3 is pressed against an inner peripheral surface of the bearing hole of the side plate 63 and an inner peripheral surface of the bearing hole of the support plate 67. Then, the intermediate shaft SF3 is braked. Further, the inner peripheral surface of the through hole of the arm member 68 is pressed against an outer peripheral surface of the intermediate shaft SF3. Then, the arm member 68 is braked. That is, when the plate spring 75 urges the separation roller shaft SF2, movement of the arm member 68 and the intermediate shaft SF3 in the thrust direction is suppressed. As a result, vibration of the intermediate shaft SF3 is suppressed. Further, wobble between the intermediate shaft SF3 and the bearing hole of the side plate 63 and wobble between the separation roller shaft SF2 and the through hole of the arm member 68 are prevented, and hence noise can be reduced. Particularly, when the plate spring 75 urges the separation roller shaft SF2 in the direction that the imaginary line connecting the center of the separation roller shaft SF2 and the center of the intermediate shaft SF3 extends, the above-mentioned effects can be enhanced.

In this embodiment, the second braking unit includes a regulating member configured to regulate the movement of the arm member 68 and a coil spring 76 serving as an urging member, which is arranged along an axial direction of the intermediate shaft SF3. In the second braking unit, as a regulating member, the support plate 67 configured to support the intermediate shaft SF3 is used. The intermediate shaft SF3 is inserted into a cavity inside a winding of the coil spring 76, and the coil spring 76 is mounted to the intermediate shaft SF3. Further, the coil spring 76 is arranged between the arm member 68 and the separation lever 70 along the axial direction of the intermediate shaft SF3. The coil spring 76 urges the arm member 68 along the intermediate shaft SF3 in the thrust direction, to thereby press the arm member 68 against the support plate 67. That is, a base end side (swing center side) of the arm member 68 supporting the separation roller shaft SF2 is pressed against the support plate 67 by the coil spring 76. Further, the movement of the arm member 68 along the intermediate shaft SF3 in the thrust direction is suppressed. Movement of the separation lever 70 is regulated in the axial direction of the intermediate shaft SF3 by a retaining ring 77, and the separation lever 70 functions as a spring receiving member configured to receive one end of the coil spring 76. Through suppression of the movement of the arm member 68 in the thrust direction, movement of the separation roller shaft SF2 in the thrust direction is also suppressed. The coil spring 76 urges the separation lever 70 regulated in position by the retaining ring 77, in a direction away from the support plate 67. With this, the retaining ring 78 (see FIG. 4) configured to fix the intermediate shaft SF3 to the support plate 67 and the bearing portion of the support plate 67 are brought into abutment against each other. As a result, wobble of the intermediate shaft SF3 in the thrust direction is prevented, and movement of the intermediate shaft SF3 in the thrust direction is suppressed. With this, vibration of the arm member 68, the separation roller shaft SF2, and the intermediate shaft SF3 in the thrust direction is suppressed, and hence noise can be reduced.

With reference to the illustrated embodiment, the image forming system 1 including the sheet feeding apparatus 5, which is an example of the sheet conveying apparatus according to the present invention, is described above. However, the present invention is not limited to the illustrated embodiment. For example, in the illustrated embodiment, the sheet conveying mechanism of the sheet feeding portion 7, which is described as a part of the image forming apparatus 2, is also one kind of the sheet conveying apparatus. A configuration of the above-mentioned separating and feeding mechanism 52 of the sheet feeding apparatus 5 can be applied to configurations of the pickup roller 15 and the separation roller pair 16 of the sheet feeding portion 7. With this, a stick-slip phenomenon and noise generated by the stick-slip phenomenon in the separation roller pair 16 can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-256162, filed Dec. 28, 2015, which is hereby incorporated by reference herein in its entirety.

What is claimed is:

1. A sheet conveying apparatus, which is configured to convey a sheet, comprising:

a rotary portion configured to rotate to convey a sheet, the rotary portion configured to rotate about a first shaft center, the first shaft center being a shaft center of a shaft portion;

a support portion configured to support the shaft portion;

a support shaft member configured to support the support portion in a rotatable manner about a second shaft center, the second shaft center being a shaft center of the support shaft member, the second shaft center being different from the first shaft center;

a support member configured to support the support shaft member;

an urging portion configured to urge the support portion in a direction of the second shaft center, the support shaft member being inserted through the urging portion;

a regulating portion configured to regulate a position of the support portion urged by the urging portion; and a receiving member configured to receive an urging force from the urging portion, the receiving member being mounted to the support shaft member;

wherein the support portion and the urging portion arranged between the regulating portion and the receiving member, and the regulating portion and the receiving member are arranged on one side with respect to a support position, where the support member supports the support shaft member, in the direction of the second shaft center.

2. A sheet conveying apparatus according to claim 1, wherein the urging portion comprises a coil spring.

3. A sheet conveying apparatus according to claim 1, further comprising:

an elastic member configured to urge the shaft portion in a direction intersecting a direction of the first shaft center.

4. A sheet conveying apparatus according to claim 3, further comprising:

a bearing member which is mounted to the shaft portion and against which the elastic member is brought into abutment, wherein the elastic member urges the shaft portion through intermediation of the bearing member.

5. A sheet conveying apparatus according to claim 1, further comprising:

a conveyance rotary member configured to convey a sheet under a state in which the sheet is nipped between the conveyance rotary member and the rotary portion.

6. A sheet conveying apparatus according to claim 1, further comprising:

a transmitting unit configured to transmit rotation of the support shaft member to the rotary portion.

7. A sheet conveying apparatus, which is configured to convey a sheet, comprising:

a conveyance rotary member configured to rotate to convey a sheet;

a separation rotary member coming into press contact with the conveyance rotary member and configured to separate sheets into individual sheets and to rotate about a first shaft center, the first shaft center being a shaft center of a shaft portion;

a support portion configured to support the shaft portion;

a support shaft member configured to support the support portion in a rotatable manner about a second shaft center, the second shaft center being a shaft center of the support shaft member, the second shaft center being different from the first shaft center;

a support member configured to support the support shaft member;

an urging member configured to urge the support portion in a direction of the second shaft center, the support shaft member being inserted through the urging member;

a regulating member configured to regulate a position of the support portion urged by the urging member; and a receiving member configured to receive an urging force from the urging member, the receiving member being mounted to the support shaft member, wherein the support portion and the urging member are arranged between the regulating member and the receiving member, and the regulating member and the receiving member are arranged on one side with respect to a support position, where the support member supports the support shaft member, in the direction of the second shaft center.

8. A sheet conveying apparatus according to claim 7, wherein the urging member comprises a coil spring.

9. A sheet conveying apparatus according to claim 7, further comprising:

a bearing which is mounted to the shaft portion, wherein the support portion is configured to support the shaft portion between the bearing and the separation rotary member.

10. A sheet conveying apparatus according to claim 7, wherein a first through-hole, through which the support shaft member is inserted, is formed in a base end of the support portion, and wherein a second through-hole, through which the shaft portion is inserted, is formed in a distal end of the support portion.

11. A sheet conveying apparatus according to claim 7, further comprising:

an elastic member configured to urge the shaft portion in a direction intersecting a direction in which the separation rotary member comes into press contact with the conveyance rotary member.

12. A sheet conveying apparatus according to claim 11, further comprising:

a bearing member which is mounted to the shaft portion and against which the elastic member is brought into abutment, wherein the elastic member urges the shaft portion through intermediation of the bearing member.

13. A sheet conveying apparatus according to claim 7, further comprising:

a press contact member configured to cause the separation rotary member to come into press contact with the conveyance rotary member.

14. A sheet conveying apparatus according to claim 7, further comprising:

a transmitting unit configured to transmit rotation of the support shaft member to the conveyance rotary member.

* * * * *